US009708564B2

(12) United States Patent
Scherer et al.

(10) Patent No.: US 9,708,564 B2
(45) Date of Patent: Jul. 18, 2017

(54) USE OF CARBOXYLIC ACID ESTERS AS LUBRICANTS

(71) Applicant: BASF SE, Ludwigshafen (DE)

(72) Inventors: Markus Scherer, Mannheim (DE); Boris Breitscheidel, Waldsee (DE)

(73) Assignee: BASF SE, Ludwigshafen (DE)

( * ) Notice: Subject to any disclaimer, the term of this patent is extended or adjusted under 35 U.S.C. 154(b) by 200 days.

(21) Appl. No.: 14/411,670

(22) PCT Filed: Jun. 27, 2013

(86) PCT No.: PCT/EP2013/063560
§ 371 (c)(1),
(2) Date: Dec. 29, 2014

(87) PCT Pub. No.: WO2014/005932
PCT Pub. Date: Jan. 9, 2014

(65) Prior Publication Data

US 2015/0166926 A1 Jun. 18, 2015

(30) Foreign Application Priority Data

Jul. 6, 2012 (EP) ..... 12175371
Mar. 5, 2013 (EP) ..... 13157753

(51) Int. Cl.
*C10M 117/00* (2006.01)
*C10M 169/04* (2006.01)
*C10M 105/36* (2006.01)

(52) U.S. Cl.
CPC ..... *C10M 169/041* (2013.01); *C10M 105/36* (2013.01); *C10M 2207/2825* (2013.01); *C10N 2220/022* (2013.01); *C10N 2220/023* (2013.01); *C10N 2230/02* (2013.01); *C10N 2230/66* (2013.01); *C10N 2240/201* (2013.01); *C10N 2240/40* (2013.01)

(58) Field of Classification Search
CPC ..... C10M 2207/129
USPC ..... 508/512
See application file for complete search history.

(56) References Cited

U.S. PATENT DOCUMENTS

| | | | | |
|---|---|---|---|---|
| 2,921,089 | A | 1/1960 | Hagemeyer et al. | |
| 4,594,374 | A | 6/1986 | Stahl et al. | |
| 2010/0261628 | A1* | 10/2010 | Scherer | C10M 105/34 508/496 |
| 2013/0137614 | A1 | 5/2013 | Scherer et al. | |

FOREIGN PATENT DOCUMENTS

| | | |
|---|---|---|
| CN | 101602666 | 12/2009 |
| DE | 10-2006-001768 | 7/2007 |
| DE | 10-2007-001540 | 8/2007 |
| EP | 0158099 | 10/1985 |
| EP | 0366089 | 5/1990 |
| EP | 0938536 | 9/1999 |
| EP | 1281701 | 2/2003 |
| JP | H06-166644 | 6/1994 |
| WO | WO-98/11179 | 3/1998 |

OTHER PUBLICATIONS

PCT International Search Report in PCT/EP2013/063560, mailed Sep. 19, 2013, 4 pages.
Zhao, Xutao, et al., Lubricants and Lubrication, *Chemical Industry Press, First Edition* Feb. 28, 2003, p. 60, 8 pages.

* cited by examiner

*Primary Examiner* — Vishal Vasisth
(74) *Attorney, Agent, or Firm* — Drinker Biddle & Reath LLP

(57) ABSTRACT

The presently claimed invention is directed to the use of carboxylic acid esters which are obtained by reacting aliphatic dicarboxylic acids and a mixture of structurally different monoalcohols having 10 carbon atoms as lubricants and a process for their preparation.

19 Claims, No Drawings

USE OF CARBOXYLIC ACID ESTERS AS LUBRICANTS

CROSS-REFERENCE TO RELATED APPLICATIONS

This application is the National Stage entry of PCT/EP2013/063560, filed on Jun. 27, 2013, which claims priority to European Application Numbers 12175371.9, filed on Jul. 6, 2012, and 13157753.8 filed on Mar. 5, 2013, which are incorporated herein by reference in their entireties.

The presently claimed invention is directed to the use of carboxylic acid esters which are obtained by reacting aliphatic dicarboxylic acids and a mixture of structurally different monoalcohols having 10 carbon atoms as lubricants and a process for their preparation.

The commercially available lubricant compositions are produced from a multitude of different natural or synthetic components. To improve the required properties, according to the field of use, further additives are usually added. The base oils often consist of mineral oils, highly refined mineral oils, alkylated mineral oils, poly-alpha-olefins (PAOs), polyalkylene glycols, phosphate esters, silicone oils, diesters and esters of polyhydric alcohols.

The different lubricants, such as motor oil, turbine oil, hydraulic fluid, transmission oil, compressor oil and the like, must satisfy extremely high criteria such as high viscosity index, good lubricant performance, high oxidation stability, good thermal stability or comparable properties.

High-performance lubricant oil formulations which are used as transmission, industrial or motor oils are oils with a special performance profile with regard to shear stability, low-temperature viscosity, long service life, evaporation loss, fuel efficiency, seal compatibility and wear protection. Such oils are currently being formulated preferentially with PAO (especially PAO 6) or group I, II or Group III mineral oils as carrier fluids, and with specific polymers (polyisobutylenes=PIBs, olefin copolymers=ethylene/propylene copolymers=OCPs, polyalkyl methacrylates=PMAs) as thickeners or viscosity index improvers in addition to the customary additive components. Together with PAOs, low-viscosity esters are typically being used, for example DIDA (diisodecyl adipate), DITA (diisotridecyl adipate) or TMTC (trimethylolpropane caprylate), especially as solubilizers for polar additive types and for optimizing seal compatibilities.

Esters are used as co-solvent, especially in motor oil, turbine oil, hydraulic fluid, transmission oil, compressor oil, but esters are also used as base oils, in which they are the main component. Common esters are available by known preparation methods, and preferably from the reaction of an acid with an alcohol.

EP 1 281 701 A1 discloses synthetic lubricants prepared from poly-neopentylpolyols and a mixture of linear and branched acids, wherein the ester has a viscosity of from 68 to 400 $mm^2/s$ at 40° C. These have been developed for use in cooling compressor fluids.

EP 0 938 536 A1 discloses lubricants which comprise synthetic esters which are obtained by reacting polyols with mixtures of monocarboxylic acids and optionally polybasic acids, and which have an elevated thermal and oxidative stability. The viscosity of the esters at 100° C. is not more than approx. 80 $mm^2/s$.

U.S. Pat. No. 2,921,089 describes di-(2-propyl-heptyl) adipate as educt.

DE 10 2007 001540 A1 discloses a mixture of different carboxylic acid esters which are prepared from 2-propyl-heptanol. These carboxylic acid esters can be used as plasticizers.

Although a wide variety of different carboxylic acids were developed for their use in lubricants, there is still a need for novel carboxylic acid esters which have a low viscosity and low pour points and are hydrolytically stable.

Thus, it was an object of the presently claimed invention to provide carboxylic acid esters for the use as lubricants that show a low viscosity and low pour points while being hydrolytically stable. It was another object of the presently claimed invention to provide carboxylic acid esters for the use as lubricants which facilitate solubilizing additives in lubricants.

The object was met by using carboxylic acid esters obtainable by reacting a mixture comprising a) at least one acid selected from the group consisting of aliphatic dicarboxylic acids and aliphatic dicarboxylic acid anhydrides, b1) a monoalcohol having 10 carbon atoms and a structure of the general formula I,

I

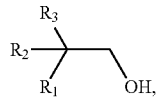

wherein $R_1$ is selected from the group consisting of pentyl, isopentyl, 2-methyl-butyl, 3-methyl-butyl and 2,2-dimethyl-propyl, $R_2$ is H or methyl, $R_3$ is selected from the group consisting of ethyl, propyl and iso-propyl, and b2) a monoalcohol having 10 carbon atoms and a structure of the general formula II,

II

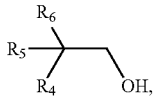

wherein $R_4$ is selected from the group consisting of pentyl, isopentyl, 2-methyl-butyl, 3-methyl-butyl and 2,2-dimethyl-propyl, $R_5$ is H or methyl, $R_6$ is selected from the group consisting of ethyl, propyl and iso-propyl, with the proviso that the monoalcohol b1) and the monoalcohol b2) have a different structure, as lubricants.

By the term of "lubricant", in the sense of the presently claimed invention, is meant a substance capable of reducing friction between moving surfaces.

Preferably, the aliphatic dicarboxylic acid is selected from the group consisting of glutaric acid, diglycolic acid, succinic acid, azelaic acid, sebacic acid, 1,4-cyclohexanedicarboxylic acid, adipic acid, 2,6-decahydronaphthalenedicarboxylic acid, 1,3-cyclohexanedicarboxylic acid, and 2,5-norbornanedicarboxylic acid. More preferably, the aliphatic dicarboxylic acid is adipic acid.

The acids can be used either in pure form or in the form of mixtures with monocarboxylic acids. Instead of the acids, their anhydrides can also be used. Representative monocarboxylic acids include n-butanoic acid, n-pentanoic acid, n-hexanoic acid, n-heptanoic acid, n-octanoic acid, nonanoic acid, n-decanoic acid, isobutanoic acid, isopentanoic acid, isohexanoic acid, isoheptanoic acid, isooctanoic acid, 2-ethylhexanoic acid, isononanoic acid, 3,5,5-trimethylhexanoic acid, and isodecanoic acid.

Preferably the monoalcohol b1) is selected from the group consisting of 2-propylheptanol, 2-propyl-4-methyl-hexanol, 2-propyl-5-methyl-hexanol, 2-isopropyl-4-methyl-hexanol, 2-isopropyl-5-methyl-hexanol, 2-propyl-4,4-di methylpentanol, 2-ethyl-2,4-dimethylhexanol, 2-ethyl-2-methyl-heptanol, 2-ethyl-2,5-dimethylhexanol and 2-isopropyl-heptanol. More preferably the monoalcohol b1) is 2-propyl-heptanol.

Preferably the monoalcohol b2) is selected from the group consisting of 2-propylheptanol, 2-propyl-4-methyl-hexanol, 2-propyl-5-methyl-hexanol, 2-isopropyl-4-methyl-hexanol, 2-isopropyl-5-methyl-hexanol, 2-propyl-4,4-dimethylpentanol, 2-ethyl-2,4-dimethylhexanol, 2-ethyl-2-methyl-heptanol, 2-ethyl-2,5-dimethylhexanol and 2-isopropyl-heptanol. More preferably the monoalcohol b2) is 2-propyl-4-methyl-hexanol.

Preferably the weight ratio of monoalcohol b1) to monoalcohol b2) is in the range of 5:1 to 95:1, more preferably in the range of 6:1 to 50:1, even more preferably in the range of 10:1 to 40:1, most preferably in the range of 20:1 to 35:1.

Preferably the mixture further comprises a monoalcohol b3) having 10 carbon atoms and a structure of the general formula III,

III

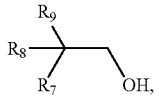

wherein $R_7$ is selected from the group consisting of pentyl, isopentyl, 2-methyl-butyl, 3-methyl-butyl and 2,2-dimethyl-propyl, $R_8$ is H or methyl, $R_9$ is selected from the group consisting of ethyl, propyl and iso-propyl, with the proviso that monoalcohol b3) has a different structure from both the monoalcohol b1) and the monoalcohol b2).

Preferably the monoalcohol b3) is selected from the group consisting of 2-propylheptanol, 2-propyl-4-methyl-hexanol, 2-propyl-5-methyl-hexanol, 2-isopropyl-4-methyl-hexanol, 2-isopropyl-5-methyl-hexanol, 2-propyl-4,4-di methylpentanol, 2-ethyl-2,4-dimethylhexanol, 2-ethyl-2-methyl-heptanol, 2-ethyl-2,5-dimethylhexanol and 2-isopropyl-heptanol. More preferably the monoalcohol b3) is 2-propyl-5-methyl-hexanol.

Preferably the mixture comprises 80 to 95 weight-% of 2-n-propyl-heptanol as component b1), 1.0 to 10 weight.% of 2-propyl-4-methyl-hexanol as component b2), 1.0 to 10 weight-% of 2-propyl-5-methyl-hexanol as component b3) and 0.1 to 2.0 weight-% of 2-isopropyl-heptanol, whereby the weight of each component is related to the total weight of the monoalcohols. More preferably the mixture comprises 91.0 to 95.0 weight-% of 2-n-propyl-heptanol as component b1), 2.0 to 5.0 weight-% of 2-propyl-4-methyl-hexanol as component b2), 3.0 to 5.0 weight-% of 2-propyl-5-methyl-hexanol as component b3) and 0.1 to 0.8 weight-% of 2-isopropyl-heptanol, whereby the weight of each component is related to the total weight of the monoalcohols.

In another embodiment, the presently claimed invention is also directed to the use of carboxylic acid esters which are obtained by reacting a mixture comprising adipic acid, 2-propyl-heptanol, 2-propyl-4-methyl-hexanol and 2-propyl-5-methyl-hexanol as lubricants.

In another embodiment, the presently claimed invention is also directed to the use of carboxylic acid esters which are obtained by reacting a mixture comprising adipic acid and 80 to 95 weight-% of 2-n-propyl-heptanol, 1.0 to 10 weight.% of 2-propyl-4-methyl-hexanol, 1.0 to 10 weight-% of 2-propyl-5-methyl-hexanol and 0.1 to 2.0 weight-% of 2-isopropyl-heptanol, whereby the weight of each component is related to the total weight of the monoalcohols, as lubricants.

Another property of the carboxylic esters to be used in accordance with the invention is their high hydrolytic stability. The hydrolytic stability was determined by measuring the acid value during a 9-day reaction with water at 100° C. as described in "Svensk Standard SS-155181". The acid value as measured according to Svensk Standard SS-155181 of the branched carboxylic esters to be used in accordance with the invention after 9-day test is preferably lower 0.5 mg KOH/g.

In another embodiment, the presently claimed invention is directed to a method for improving the hydrolytic stability of lubricants comprising providing one or more carboxylic acid esters obtainable by reacting a mixture comprising a) at least one acid selected from the group consisting of aliphatic dicarboxylic acids and aliphatic dicarboxylic acid anhydrides, b1) a monoalcohol having 10 carbon atoms and a structure of the general formula I,

I

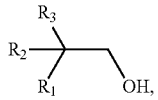

wherein $R_1$ is selected from the group consisting of pentyl, isopentyl, 2-methyl-butyl, 3-methyl-butyl and 2,2-dimethyl-propyl, $R_2$ is H or methyl, $R_3$ is selected from the group consisting of ethyl, propyl and iso-propyl, and b2) a monoalcohol having 10 carbon atoms and a structure of the general formula II,

II

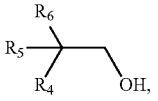

wherein $R_4$ is selected from the group consisting of pentyl, isopentyl, 2-methyl-butyl, 3-methyl-butyl and 2,2-dimethyl-propyl, $R_5$ is H or methyl, $R_6$ is selected from the group consisting of ethyl, propyl and iso-propyl, with the proviso that the monoalcohol b1) and the monoalcohol b2) have a different structure, as lubricants.

In another embodiment, the presently claimed invention is directed a process for the preparation of carboxylic acid esters comprising at least the steps of i) reacting a mixture comprising a) at least one acid selected from the group consisting of aliphatic dicarboxylic acids and aliphatic dicarboxylic acid anhydrides, b1) a monoalcohol having 10 carbon atoms and a structure of the general formula I,

I

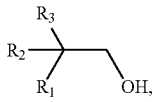

wherein $R_1$ is selected from the group consisting of pentyl, iso-pentyl, 2-methyl-butyl, 3-methyl-butyl and 2,2-dimethyl-propyl, $R_2$ is H or methyl, $R_3$ is selected from the group consisting of ethyl, propyl and iso-propyl, and b2) a monoalcohol having 10 carbon atoms and a structure of the general formula II,

II

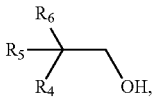

wherein $R_4$ is selected from the group consisting of pentyl, iso-pentyl, 2-methyl-butyl, 3-methyl-butyl and 2,2-dimethyl-propyl, $R_5$ is H or methyl, $R_6$ is selected from the group consisting of ethyl, propyl and iso-propyl, with the proviso that the monoalcohol b1) and the monoalcohol b2) have a different structure, in the presence of at least one catalyst selected from the group consisting of titanium-containing compounds, zirconium-containing compounds and tin-containing compounds, ii) heating the mixture obtained according to step i) to a temperature in the range of 80° C. to 160° C., iii) adding a basic aqueous solution, and iv) removing remaining monoalcohol b1) and monoalcohol b2).

Optionally, the carboxylic acid ester which was thus obtained can be further purified by drying and filtering.

The reaction between acid a) and monoalcohols b1), b2) and optionally b3) can be carried out using stoichiometric amounts of monoalcohols b1), b2) and optionally b3) and acid, particularly when entrainers are used. However, preference is given to using a stoichiometric excess of the alcohol of from 0.05 to 1.0 mole per mole of acid a) in order to achieve a complete conversion of the acid a).

Preferably, the esterification reaction between acid a) and monoalcohols b1), b2) and optionally b3) is carried out in two stages. In the first stage, without addition of a catalyst, the monoester of the acid a) is formed. The temperatures to be employed in this stage depend largely on the starting materials. Satisfactory reaction rates are achieved above 100° C., and preferably above 120° C. It is possible to complete the monoester formation at these temperatures. However, it is more advantageous to increase the temperature continuously up to 160° C. When using acids (rather than carboxylic anhydrides) as esterification component, the water formed is removed from the reaction system as an azeotrope with the alcohol, as long as the reaction temperature is above the boiling point of the azeotrope (i.e. in a range from 90 to 100° C. under atmospheric pressure). The course and completion of the esterification can in this case be observed via the formation of water. The use of subatmospheric or superatmospheric pressure is not ruled out, but will be restricted to special cases. To suppress the occurrence of concentration differences, it is advisable to stir the reactor contents or to mix them from time to time, e.g. by passing an inert gas through the reaction mixture.

In another embodiment of the presently claimed invention, the inventively claimed carboxylic acid esters can be worked up by filtration optionally followed by distillation.

In the second stage, the esterification of the acid a) is completed. The second stage is a carried out in the presence of the above-described catalysts at temperatures which are above those employed in the first stage and go up to 250° C. Water formed during the reaction is removed as an azeotrope, with the alcohol acting as an entrainer.

After completion of the reaction the reaction mixture comprises not only the desired reaction product, but also partially esterified dicarboxylic or polycarboxylic acids, excess alcohol and the catalyst.

To work up the crude ester the product from the reactor is first neutralized with alkali metal hydroxide or alkaline earth metal hydroxide. The alkaline reagent is employed as an aqueous solution containing from 5 to 20 weight-%, preferably from 10 to 15 weight-%, of the hydroxide, based on the overall weight of the solution. The amount of neutralizing agent to be used depends on the proportion of acid components, free acid and monoesters in the crude product. The use of the selected hydroxides, among which sodium hydroxide has been found to be particularly useful, as aqueous solution having a particular concentration and in a defined excess ensures that the acidic constituents of the reaction mixture are precipitated in a crystalline, very readily filterable form. At the same time, the catalyst is largely decomposed to form likewise easily filterable products. The alkaline treatment of the crude ester is not tied to the maintenance of particular temperatures. It is advantageously carried out immediately after the esterification step without prior cooling of the reaction mixture.

Subsequently any free alcohol is separated from the reaction mixture. Steam distillation has been found to be useful for this step and can be carried out in simple form by passing steam into the crude product.

The removal of the free alcohol is followed by the drying of the ester. In a particularly simple and effective embodiment of this step, drying is achieved by passing an inert gas through the product. The crude ester is then filtered to free it of solids. The filtration is carried out in conventional filtration equipment at room temperature or at temperatures up to 150° C. The filtration can also be facilitated by customary filter aids such as cellulose or silica gel.

In another embodiment, the presently claimed invention is directed to the use of a mixture comprising a diester (1) of an acid selected from the group consisting of aliphatic dicarboxylic acids and aliphatic dicarboxylic acid anhydrides and b1) a monoalcohol having 10 carbon atoms and a structure of the general formula I,

I

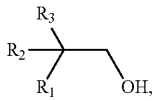

wherein $R_1$ is selected from the group consisting of pentyl, iso-pentyl, 2-methyl-butyl, 3-methyl-butyl and 2,2-dimethyl-propyl, $R_2$ is H or methyl, $R_3$ is selected from the group consisting of ethyl, propyl and iso-propyl, and a diester (2) of an acid selected from the group consisting of aliphatic dicarboxylic acids and aliphatic dicarboxylic acid anhydrides and b2) a monoalcohol having 10 carbon atoms and a structure of the general formula II,

II

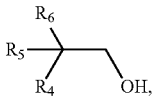

wherein $R_4$ is selected from the group consisting of pentyl, iso-pentyl, 2-methyl-butyl, 3-methyl-butyl and 2,2-dimethyl-propyl, $R_5$ is H or methyl, $R_6$ is selected from the group consisting of ethyl, propyl and iso-propyl, with the proviso that the monoalcohol b1) and the monoalcohol b2) have a different structure, as lubricants.

The invention further relates to the use of the inventively claimed carboxylic acid esters as co-solvents or base oils in lubricant compositions and fuel additives. The carboxylic acid esters can be used as additives, respectively co-solvents, in an amount from 0.1 to 50% weight-% or as main component in a lubricant composition, in an amount from 50 weight-% to 100 weight-%. When applying the carboxylic acid esters as additive, the carboxylic acid esters are preferably used in an amount of 3.5 to 45 weight-%, more preferably in an amount of 5 to 35 weight-%, most preferably in an amount of 10 to 30 weight-%, in the lubricant compositions.

Lubricant compositions and industrial oils comprising carboxylic acid esters can be used for various applications such as light, medium and heavy duty engine oils, industrial engine oils, marine engine oils, crankshaft oils, compressor oils, refrigerator oils, hydrocarbon compressor oils, very low-temperature lubricating oils and fats, high temperature lubricating oils and fats, wire rope lubricants, textile machine oils, refrigerator oils, aviation and aerospace lubricants, aviation turbine oils, transmission oils, gas turbine oils, spindle oils, spin oils, traction fluids, transmission oils, plastic transmission oils, passenger car transmission oils, truck transmission oils, industrial transmission oils, industrial gear oils, insulating oils, instrument oils, brake fluids, transmission liquids, shock absorber oils, heat distribution medium oils, transformer oils, fats, chain oils, minimum quantity lubricants for metalworking operations, oil to the warm and cold working, oil for water-based metalworking liquids, oil for neat oil metalworking fluids, oil for semi-synthetic metalworking fluids, oil for synthetic metalworking fluids, drilling detergents for the soil exploration, hydraulic oils, in biodegradable lubricants or lubricating greases or waxes, chain saw oils, release agents, moulding fluids, gun, pistol and rifle lubricants or watch lubricants and food grade approved lubricants.

In a preferred embodiment the carboxylic acid esters of the present invention are used as co-solvents or base oils in lubricant compositions, industrial oils, metalworking fluids, transformer oils biodegradable lubricants and seal plasticizing agents.

The lubricant composition comprising the carboxylic acid esters of the presently claimed invention may preferably comprises further additives such as polymer thickeners, viscosity index VI improvers, antioxidants, corrosion inhibitors, detergents, dispersants, demulsifiers, defoamers, dyes, wear protection additives, EP (extreme pressure) additives, AW (antiwear) additives and friction modifiers.

Further the lubricant composition comprising the carboxylic acid esters of the presently claimed invention may comprise other base oils and/or co-solvents like mineral oils (Gr I, II or III oils), polyalphaolefins, alkyl naphthalenes, mineral oil soluble polyalkylene glycols, silicone oils, phosphate esters and/or other carboxylic acid esters.

Typical additives found in hydraulic fluids include dispersants, detergents, corrosion inhibitors, antiwear agents, antifoaming agents, friction modifiers, seal swell agents, demulsifiers, viscosity index VI improvers, and pour point depressants.

Examples of dispersants include polyisobutylene succinimides, polyisobutylene succinate esters and Mannich Base ashless dispersants.

Examples of detergents include metallic alkyl phenates, sulfurized metallic alkyl phenates, metallic alkyl sulfonates and metallic alkyl salicylates.

Examples of anti-wear additives include organo borates, organo phosphites, organic sulfur-containing compounds, zinc dialkyl dithiophosphates, zinc diaryl dithiophosphates and phos-phosulfurized hydrocarbons.

Examples of friction modifiers include fatty acid esters and amides, organo molybdenum compounds, molybdenum dialkylthiocarbamates and molybdenum dialkyl dithiophosphates.

An example of an antifoaming agent is polysiloxane. Examples of rust inhibitors are polyoxyalkylene polyols, carboxylic acids or triazol components. Examples of viscosity index VI improvers include olefin copolymers, polyalkylmethacrylates and dispersant olefin copolymers. An example of a pour point depressant is polyalkylmethacrylate.

In another embodiment, the presently claimed invention is directed to a metalworking fluid containing at least one carboxylic acid ester as defined above.

Depending on the applications, e.g., straight oils (neat oils) or soluble oils, the metalworking fluid may contain applicable additives known in the art to improve the properties of the composition in amounts ranging from 0.10 to 40 wt. %. These additives include metal deactivators; corrosion inhibitors; antimicrobial; anticorrosion; emulsifying agents; couplers; extreme pressure agents; antifriction; antirust agents; polymeric substances; anti-inflammatory agents; bactericides; antiseptics; antioxidants; chelating agents; pH regulators; antiwear agents including active sulphur antiwear additive packages; a metalworking fluid additive package containing at least one of the aforementioned additives.

Depending on the end-use applications, small quantities of additives such as anti-misting agents may be optionally added in an amount ranging from 0.05 to 5.0% by vol. in one embodiment and less than 1 wt. % in other embodiments.

Non-limiting examples include rhamsan gum, hydrophobic and hydrophilic monomers, styrene or hydrocarbyl-substituted styrene hydrophobic monomers and hydrophilic monomers, oil soluble organic polymers ranging in molecular weight (viscosity average molecular weight) from about 0.3 to over 4 million such as isobutylene, styrene, alkyl methacrylate, ethylene, propylene, n-butylene vinyl acetate, etc. In one embodiment, polymethylmethacrylate or poly (ethylene, propylene, butylene or isobutylene) in the molecular weight range 1 to 3 million is used.

For certain applications, a small amount of foam inhibitors in the prior art can also be added to the composition in an amount ranging from 0.02 to 15.0 wt. %. Non-limiting examples include polydimethylsiloxanes, often trimethylsilyl terminated, alkyl polymethacrylates, polymethylsiloxanes, an N-acylamino acid having a long chain acyl group and/or a salt thereof, an N-alkylamino acid having a long chain alkyl group and/or a salt thereof used concurrently with an alkylalkylene oxide and/or an acylalkylene oxide, acetylene diols and ethoxylated acetylene diols, silicones, hydrophobic materials (e.g. silica), fatty amides, fatty acids, fatty acid esters, and/or organic polymers, modified siloxanes, polyglycols, esterified or modified polyglycols, polyacrylates, fatty acids, fatty acid esters, fatty alcohols, fatty alcohol esters, oxo-alcohols, fluorosurfactants, waxes such as ethylenebisstereamide wax, polyethylene wax, polypropylene wax, ethylenebisstereamide wax, and paraffinic wax. The foam control agents can be used with suitable dispersants and emulsifiers. Additional active foam control agents are described in "Foam Control Agents", by Henry T. Kemer (Noyes Data Corporation, 1976), pages 125-162.

The metalworking fluid further comprises anti-friction agents including overbased sulfonates, sulfurized olefins, chlorinated paraffins and olefins, sulfurized ester olefins, amine terminated polyglycols, and sodium dioctyl phosphate salts. In yet other embodiment, the composition further comprises corrosion inhibitors including carboxylic/boric acid diamine salts, carboxylic acid amine salts, alkanol amines and alkanol amine borates.

The metalworking fluid further comprises oil soluble metal deactivators in an amount of 0.01 to 0.5 vol % (based on the final oil volume). Non-limiting examples include triazoles or thiadiazoles, specifically aryl triazoles such as benzotriazole and tolyltriazole, alkyl derivatives of such triazoles, and benzothiadiazoles such as $R(C_6H_3)N_2S$ where R is H or $C_1$ to $C_{10}$ alkyl.

A small amount of at least an antioxidant in the range 0.01 to 1.0 weight % can be added. Non-limiting examples include antioxidants of the aminic or phenolic type or mixtures thereof, e.g., butylated hydroxy toluene (BHT), bis-2,6-di-t-butylphenol derivatives, sulfur containing hindered phenols, and sulfur containing hindered bisphenol.

The metalworking fluid further comprises 0.1 to 20 wt. % of at least an extreme-pressure agent. Non-limiting examples of extreme pressure agents include zinc dithiophosphate, molybdenum oxysulfide dithiophosphate, molybdenum oxysulfide dithiocarbamate, molybdenum amine compounds, sulfurized oils and fats, sulfurized fatty acids, sulfurized esters, sulfurized olefins, dihydrocarbyl polysulfides, thiocarbamates, thioterpenes and dialkyl thiodipropionates.

In another embodiment, the presently claimed invention is directed to a coating composition comprising the inventively claimed carboxylic acid ester. The coating composition comprises at least one resin and further additives such as rheological assistants, thickeners and pigments.

A resin composition for a coating composition of the invention comprises a binder, which may be in dispersion or solution in water, and a crosslinking agent. Examples of water-dilutable binders that can be used include water-dilutable polyacrylates, water-dilutable polyesters, water-dilutable polyethers, water-dilutable melamine resins and urea resins, and water-dilutable polyurethane resins, of the kind disclosed, for instance, in EP 0 158 099 A2.

The coating compositions of the invention can comprise at least one rheological assistant. Preferably this rheological assistant is selected from the group consisting of polyurethane-based associative thickeners, carboxymethylcellulose acetobutyrate thickeners, metal silicate, and silica. The further rheological assistant is preferably a metal silicate.

The coating compositions of the invention may comprise at least one color and/or effect pigment. Examples include titanium dioxide, graphite, carbon black, phthalocyanine blue, chromium oxide, and perylenetetracarboximides. The color and/or effect pigments are preferably selected from the group consisting of organic and inorganic, coloring, extending, rheology-controlling, optical-effect-imparting, electrically conductive, magnetically shielding, and fluorescent pigments, metallic pigments and metal powders, organic and inorganic, transparent or hiding fillers, and nanoparticles. Preference is given to a coating composition which comprises a metallic pigment. With particular preference the metallic pigment is selected from the group consisting of aluminum, bismuth oxychloride, mica, titanium oxide-coated mica, iron oxide-coated mica, micaceous iron oxide, titanium oxide-coated silica, titanium oxide-coated aluminum, iron oxide-coated silica, and iron oxide-coated aluminum. Where further color pigments are present in the coating compositions of the invention, as well as the metallic pigments, the nature and amount of the color pigments are selected such that the desired metallic effect is not suppressed. The mass fraction of the metal powder, based on the total binder solids, is up to 32% by mass, preferably 12% to 28% by mass.

The coating compositions of the invention may also comprise further typical additions such as fillers, plasticizers, stabilizers, wetting agents, dispersing assistants, flow control agents, defoamers, and catalysts, individually or in a mixture.

The following examples illustrate the invention without, however, being limited thereto.

EXAMPLES

DIDA is commercially available for example as Synative® ES DIDA from BASF SE, Ludwigshafen Propylheptanol is commercially available from BASF SE, Ludwigshafen [93.0% by weight 2-propyl-heptanol; 2.9% by weight 2-propyl-4-methyl-hexanol; 3.9% by weight 2-propyl-5-methyl-hexanol and 0.2% by weight 2-isopropylheptanol]

Example 1

Preparation of Di-(2-propylheptyl)-adipate (DPHA)

A mixture of structural isomers of an alcohol with 10 carbon atoms which is available by BASF SE as "propylheptanol" (2.4 mol) and adipic acid (1.0 mol) is reacted in the present of iso-propyl-butyl-titanate (0.001 mol) in an autoclave under inert gas ($N_2$) at a reaction temperature of 230° C. Water which is formed during the reaction is removed from the reaction mixture through an inert gas stream ($N_2$-stream). After 180 minutes the excess alcohol is removed from the mixture by distillation at a pressure of 50 mbar. The thus obtained adipic acid ester is then neutralised with 0.5% NaOH at 80° C. Afterwards the organic phase and the aqueous phase are separated, followed by washing the organic phase two times with water. In a further step the organic phase is purified by treating the crude adipic acid ester with steam at 180° C. and 50 mbar. Then the ester is dried by subjecting it to a $N_2$ stream at 150° C. and 50 mbar. Finally the ester is mixed with activated carbon and is filtered using as a rheological agent supra-theorit at 80° C. under reduced pressure. The adipic acid ester shows a density of 0.916 g/cm$^3$ at 20° C., measured according to DIN 51757, respectively ASTM D 4052.

Example 2

Viscosity Measurement

The viscosity of the esters is determined in a standard test according to DIN 51562-1.

Pour Point Measurement

The pour point of the esters is determined in a standard test according to ASTM D97.

Demulsification Measurement

The viscosity of the esters is determined in a standard test according to DIN ISO 6614.

TABLE 1

| | Method | DIDA | DPHA | Unit |
|---|---|---|---|---|
| Viscosity at 40° C. | DIN 51562-1 | 13.9 | 11.49 | mm$^2$/s |
| Viscosity at 100° C. | DIN 51562-1 | 3.6 | 2.98 | mm$^2$/s |
| Pour point | ASTM D97 | −60 | −80 | ° C. |
| Demulsification | DIN ISO 6614 | 10/35/35 | 40/40/0 | minutes |

Example 3

Cloud Point Measurement

The cloud point of the esters is determined in a standard test according to ASTM D5773.

TABLE 2

Lubricant formulations A and B (all values in weight-%)

| | Formulation A with DIDA | Formulation B with DPHA |
|---|---|---|
| PAO 6 (Nexbase ® 2006, polyalpha-olefin, obtainable from Neste Oil N.V, Belgium) | 52.0% | 52.0% |
| DIDA | 10.0% | — |
| DPHA | — | 10.0% |
| Thickener (Lubrizol ® 8406, polyiso-butylene, available from Lubrizol) | 13.0% | 13.0% |
| Thickener (Lubrizol ® 8407 from Lubrizol) | 13.0% | 13.0% |
| Additives (Anglamol ® 6004, additive package available from Lubrizol) | 12.0% | 12.0% |
| Viscosity at 40° C. | 113.75 mm$^2$/s | 112.75 mm$^2$/s |
| Viscosity at 100° C. | 16.71 mm$^2$/s | 16.56 mm$^2$/s |
| Viscosity index (VI) | 160 | 159 |
| Density at 15° C. | 0.8660 g/ml | 0.8648 g/ml |
| Cloud Point | −32.0° C. | −47.0° C. |
| Brookfield viscosity at −40° C. | 101 000 mPa/s | 99 000 mPa/s |

The lower cloud point is a result of the improved solubility of the additives in the formulations.

Example 4

Hydrolysis Test

The hydrolytic stability was determined by measuring the acid value during a 9-day reaction with water at 100° C. as described in "Svensk Standard S-155181".

TAN=total acid number in mg KOH/g

TABLE 3

| | DPHA | | DIDA | |
|---|---|---|---|---|
| Day | Value (TAN) | Increase [%] | Value (TAN) | Increase [%] |
| 0 | 0.22 | | 0.27 | |
| 1 | 0.09 | −0.13 | 0.44 | 0.17 |
| 2 | 0.13 | −0.09 | 0.17 | −0.10 |
| 3 | 0.17 | −0.05 | 0.17 | −0.10 |
| 6 | 0.25 | 0.03 | 0.78 | 0.51 |
| 8 | 0.26 | 0.04 | 1.09 | 0.82 |
| 9 | 0.28 | 0.06 | 1.29 | 1.02 |

The invention claimed is:

1. A lubricant composition comprising one or more carboxylic acid esters that are obtainable by reacting a mixture comprising:

a) at least one acid selected from the group consisting of aliphatic dicarboxylic acids and aliphatic dicarboxylic acid anhydrides, b1) a monoalcohol having 10 carbon atoms and a structure of the general formula I,

I

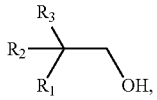

wherein $R_1$ is selected from the group consisting of pentyl, isopentyl, 2-methyl-butyl, 3-methyl-butyl and 2,2-dimethyl-propyl, $R_2$ is H or methyl, $R_3$ is selected from the group consisting of ethyl, propyl and iso-propyl, and b2) a monoalcohol having 10 carbon atoms and a structure of the general formula II,

II

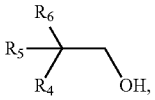

wherein $R_4$ is selected from the group consisting of pentyl, isopentyl, 2-methyl-butyl, 3-methyl-butyl and 2,2-dimethyl-propyl, $R_5$ is H or methyl, $R_6$ is selected from the group consisting of ethyl, propyl and iso-propyl, with the proviso that the monoalcohol b1) and the monoalcohol b2) have a different structure and the monoalcohols b1) and b2) are present in a molar ratio in the range of 1.05:1 to 2.0:1 in relation to the acid a) and a weight ratio of monoalcohol b1) to monoalcohol b2) is in the range of 5:1 to 95:1.

2. The lubricant composition of claim 1, wherein the aliphatic dicarboxylic acid is selected from the group consisting of glutaric acid, diglycolic acid, succinic acid, azelaic acid, sebacic acid, 1,4-cyclohexanedicarboxylic acid, adipic acid, 2,6-decahydronaphthalenedicarboxylic acid, 1,3-cyclohexanedicarboxylic acid, and 2,5-norbornanedicarboxylic acid.

3. The lubricant composition of claim 1, wherein the aliphatic dicarboxylic acid is adipic acid.

4. The lubricant composition of claim 1, wherein $R_1$ is pentyl, $R_2$ is H, and $R_3$ is propyl.

5. The lubricant composition of claim 1, wherein $R_4$ is 2-methyl-butyl, $R_5$ is H, and $R_6$ is propyl.

6. The lubricant composition of claim 1, wherein the mixture further comprises a monoalcohol b3) having 10 carbon atoms and a structure of the general formula III,

III

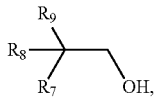

wherein $R_7$ is selected from the group consisting of pentyl, isopentyl, 2-methyl-butyl, 3-methyl-butyl and 2,2-dimethyl-propyl, $R_8$ is H or methyl, $R_9$ is selected from the group consisting of ethyl, propyl and iso-propyl, with the proviso that monoalcohol b3) has a different structure from both the monoalcohol b1) and the monoalcohol b2).

7. The lubricant composition of claim 1 obtainable by reacting a mixture comprising adipic acid, 2-propyl-heptanol, 2-propyl-4-methyl-hexanol and 2-propyl-5-methyl-hexanol.

8. A method for improving the hydrolysis stability of lubricants comprising obtaining as lubricants one or more carboxylic acid esters obtainable by reacting a mixture comprising:

a) at least one acid selected from the group consisting of aliphatic dicarboxylic acids and aliphatic dicarboxylic acid anhydrides, b1) a monoalcohol having 10 carbon atoms and a structure of the general formula I,

I

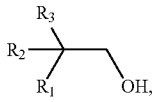

wherein $R_1$ is selected from the group consisting of pentyl, isopentyl, 2-methyl-butyl, 3-methyl-butyl and 2,2-dimethyl-propyl, $R_2$ is H or methyl, $R_3$ is selected from the group consisting of ethyl, propyl and iso-propyl, and b2) a monoalcohol having 10 carbon atoms and a structure of the general formula II,

II

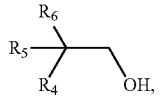

wherein $R_4$ is selected from the group consisting of pentyl, isopentyl, 2-methyl-butyl, 3-methyl-butyl and 2,2-dimethyl-propyl, $R_5$ is H or methyl, $R_6$ is selected from the group consisting of ethyl, propyl and iso-propyl, with the proviso that the monoalcohol b1) and the monoalcohol b2) have a different structure and the monoalcohols b1) and b2) are present in a molar ratio in the range of 1.05:1 to 2.0:1 in relation to the acid a) and a weight ratio of monoalcohol b 1) to monoalcohol b2) is in the range of 5:1 to 95:1.

9. The lubricant composition of claim 1 further comprising one or more additives selected from the group consisting of polymer thickeners, viscosity index (VI) improvers, antioxidants, corrosion inhibitors, detergents, dispersants, demulsifiers, defoamers, dyes, wear protection additives, EP (extreme pressure) additives, AW (antiwear) additives, and friction modifiers.

10. The lubricant composition of claim 1 that is effective as an industrial oil.

11. The lubricant composition of claim 1, comprising a diester (1) of an acid selected from the group consisting of aliphatic dicarboxylic acids and aliphatic dicarboxylic acid anhydrides and b1) a monoalcohol having 10 carbon atoms and a structure of the general formula I,

I

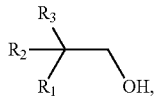

wherein $R_1$ is selected from the group consisting of pentyl, isopentyl, 2-methyl-butyl, 3-methyl-butyl and 2,2-dimethyl-propyl, $R_2$ is H or methyl, $R_3$ is selected from the group consisting of ethyl, propyl and iso-propyl, and a diester (2) of an acid selected from the group consisting of aliphatic dicarboxylic acids and aliphatic dicarboxylic acid anhydrides and b2) a monoalcohol having 10 carbon atoms and a structure of the general formula II,

II

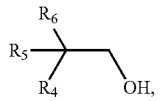

wherein $R_4$ is selected from the group consisting of pentyl, isopentyl, 2-methyl-butyl, 3-methyl-butyl and 2,2-dimethyl-propyl, $R_5$ is H or methyl, $R_6$ is selected from the group consisting of ethyl, propyl and iso-propyl, as lubricants.

12. The method of claim 8 further comprising adding one or more additives selected from the group consisting of polymer thickeners, viscosity index (VI) improvers, antioxidants, corrosion inhibitors, detergents, dispersants, demulsifiers, defoamers, dyes, wear protection additives, EP (extreme pressure) additives, AW (antiwear) additives, and friction modifiers to the one or more carboxylic acid esters.

13. A metalworking fluid which comprises the lubricant composition of claim 1.

14. A transformer oil which comprises the lubricant composition of claim 1.

15. A coating composition which comprises the lubricant composition of claim 1.

16. A plasticizing agent which comprises the lubricant composition of claim 1.

17. The lubricant composition of claim 1, wherein the weight ratio of monoalcohol b1) to monoalcohol b2) is in the range of 6:1 to 50:1.

18. The lubricant composition of claim 1, wherein the weight ratio of monoalcohol b1) to monoalcohol b2) is in the range of 10:1 to 40:1.

19. The lubricant composition of claim 1, wherein the weight ratio of monoalcohol b1) to monoalcohol b2) is in the range of 20:1 to 35:1.

* * * * *